United States Patent [19]

Koyama et al.

[11] Patent Number: 4,738,642

[45] Date of Patent: Apr. 19, 1988

[54] SLIDABLE MOUNTING BOARD FOR SMALL WATER CRAFT

[75] Inventors: Toshiki Koyama, Akashi; Yoshiyuki Kohyama, Inami; Masayuki Inoue, Akashi; Yoshio Fujimoto, Kobe, all of Japan

[73] Assignee: Kawasaki Jukogyo Kabushiki Kaisha, Japan

[21] Appl. No.: 852,136

[22] Filed: Apr. 15, 1986

[30] Foreign Application Priority Data

Apr. 17, 1985 [JP] Japan ..... 60-57240[U]

[51] Int. Cl.[4] ..... B63B 17/00

[52] U.S. Cl. ..... 440/38; 114/362; 441/39

[58] Field of Search ..... 114/270, 285, 343, 348, 114/362, 364; 441/39, 40; 182/91, 97, 98, 194; 16/225, 226; 440/38

[56] References Cited

U.S. PATENT DOCUMENTS

| | | | |
|---|---|---|---|
| 3,372,663 | 3/1968 | Lo Bue | 114/285 |
| 3,561,039 | 2/1971 | Amrein | 16/226 |
| 3,601,078 | 8/1971 | Bedford | 114/285 |
| 3,774,720 | 11/1973 | Hovey | 114/362 |
| 3,826,220 | 7/1974 | Jacobson | 114/270 |
| 3,989,002 | 11/1976 | Peterson | 114/270 |

FOREIGN PATENT DOCUMENTS

| | | | |
|---|---|---|---|
| 449793 | 6/1977 | Japan | 114/270 |
| 183197 | 4/1963 | Sweden | 441/40 |
| 634271 | 3/1950 | United Kingdom | 441/40 |
| 1585865 | 3/1981 | United Kingdom | 114/362 |
| 490710 | 11/1975 | U.S.S.R. | 114/362 |

*Primary Examiner*—Joseph F. Peters, Jr.
*Assistant Examiner*—Stephen P. Avila

[57] ABSTRACT

Disclosed is a small power-driven water craft of the type whose body is composed in the main of longitudinal two parts, the deck and the hull, with a standing platform in the deck at its rear portion and a stearing handle in front of the platform. In the deck at its stern side end is provided a mounting board that extends far below the bottom of the hull, adapted to permit a displaced rider to climb on board from the stern, without suffering the usual difficulty in doing so because of the imbalanced state of a craft when it is just floating in the water. In a preferred embodiment,, the mounting board is slidably disposed on a sloped surface formed at the stern for movement between a raised position where the board is pulled clear out of the water and a lowered position where it stands extending at an angle into the water, conveniently for a displaced rider to grip on to its surface with his toe or knee in getting on board. Further, the mounting board is moved between the foregoing positions through a wire rope connected to a hand winch whose handle is mounted at a forward portion of the deck, situated low enough to be within the arm's reach of a person near the craft's side in the water so that he, displaced from the craft, can operate the handle to lower the mounting board.

5 Claims, 3 Drawing Sheets

SLIDABLE MOUNTING BOARD FOR SMALL WATER CRAFT

BACKGROUND OF THE INVENTION

1. Field of the Invention

The present invention relates in general to a small power-driven aquatic craft or water-borne vehicle of the type whose body composed of an upper deck part and a lower hull part, with a standing platform formed in the deck at its rear portion and a stearing handle mounted in front of the platform, and in particular to such a vehicle having a mounting step mounted at the stern to permit a displaced rider from the vehicle to get on board onto the platform again.

2. Description of the Prior Art

In the prior art, various types of small power-driven aquatic craft or water-borne vehicles of the type the body of which is composed of main two longitudinal parts, the deck and the hull integrally bonded to the former, with a standing platform in the deck at its rear portion and a stearing handle in front of the platform, at which the operator standing on the platform drives the craft. One such a vehicle has been disclosed in Japanese Design No. 449,793.

It sometimes happens that such a water craft gets overturned during operation for one reason or another, throwing its rider out of board. However, those prior art water craft have had the operational disadvantage in that, once the rider is thrown clear out of board from the inadvertently overturned vehicle, it is required for the rider to get onto it again, after it has been turned back into its normal position.

This disadvantage is further aggravated with a double-rider type small water craft when it gets overturned inadvertently causing both riders to fall therefrom. Not only that the first person attempting to get on board, after the craft has been corrected, will experience extreme hardship in doing so, but also that, after the first person success in remounting, the weight of that first person on the vehicle body places it in an imbalanced state which makes it much more difficult for the second person to come on board.

The present invention has been proposed to eliminate the above-mentioned problem. It is therefore a main object of this invention to provide a small water craft having means which facilitates a displaced rider to get on board again.

SUMMARY OF THE INVENTION

The above and other objects, features and advantages of the present invention is achieved by the water craft construction having a mounting step that extends downwardly into the water below the craft body bottom at its stern.

These and other features and advantages of the present invention will be move fully understood and appreciated from the following description of specific embodiment taken together with the accompanying drawings.

DESCRIPTION OF THE PREFERRED EMBODIMENTS

The preferred embodiment according to the present invention will be described in detail in conjunction with the accompanying drawings.

Figure 1:
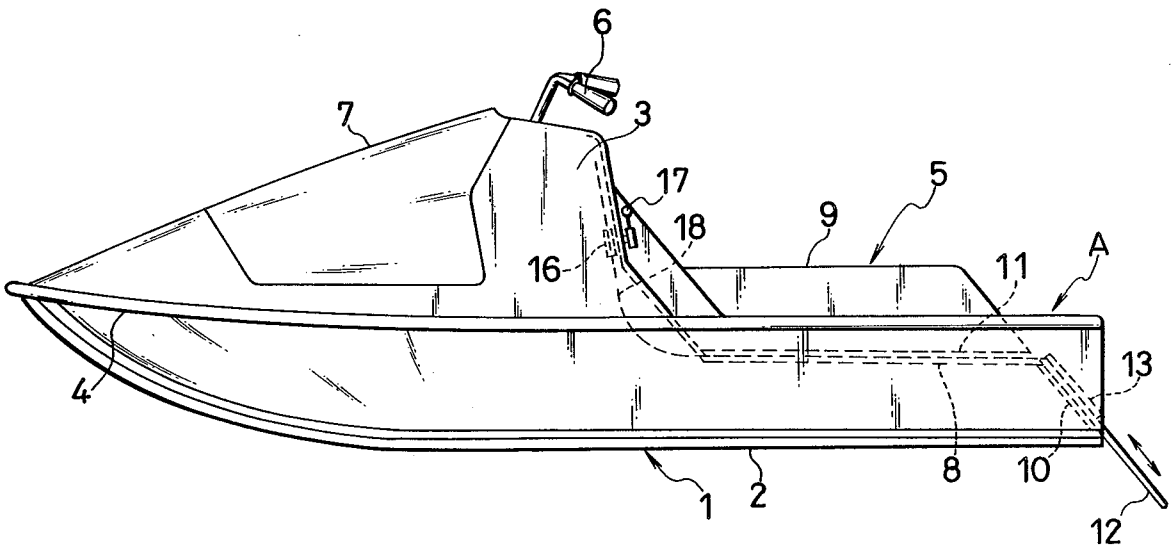
FIG. 1 is a side view, as seen in the direction of the port side, of a preferred embodiment of the small water craft constructed in accordance with the present invention.

Referring first to FIG. 1, the water craft body, largely designated at 1, may be formed of glassfiber reinforced plastics, and may be constructed in two main longitudinally extending parts, the lower hull portion 2 and the upper deck portion 3, that are bonded together along the flanged portion 4 horizontally circumscribing the side walls of the hull 2.

The deck 3 may be a one-piece member extending from bow to stern, with a standing platform 5 formed in the deck 3 at its rear portion. A stick-like stearing handle 6 is provided mounted in front of the standing platform 5 and is operatively connected to an engine (not shown) for driving the vehicle. Also, in the deck 3 at its forward portion is mounted an engine hood 7 adapted to protect the engine and may normally be constructed such that it can be opened to permit access to the engine inside for purposes of maintenance.

Figure 2:
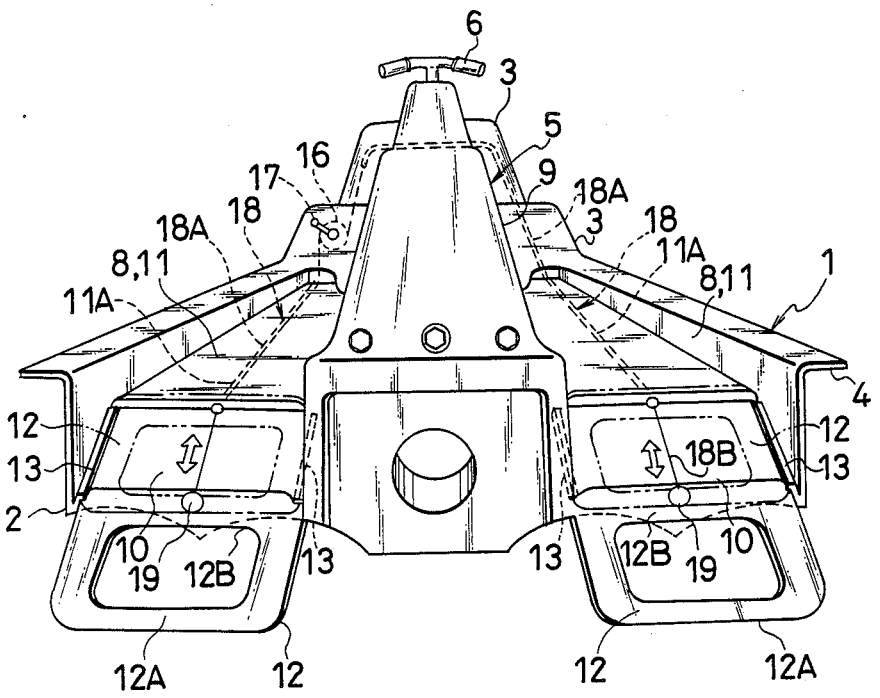
FIG. 2 is a perspective view of the embodiment depicted in FIG. 1, as seen in the direction of the bow.

Referring to FIG. 2, illustrating the craft as seen in the direction of the bow, the standing platform 5 in the deck 3 consists of a pair of parallely extending, longitudinal footboards 8, divided by a center raised portion 9 that projects upwardly from the plane of the deck 3. The paired footboards 8 are provided for a rider or riders to stand on, astride over the raised portion 9, with each foot resting on the proper footboard.

Figure 3:
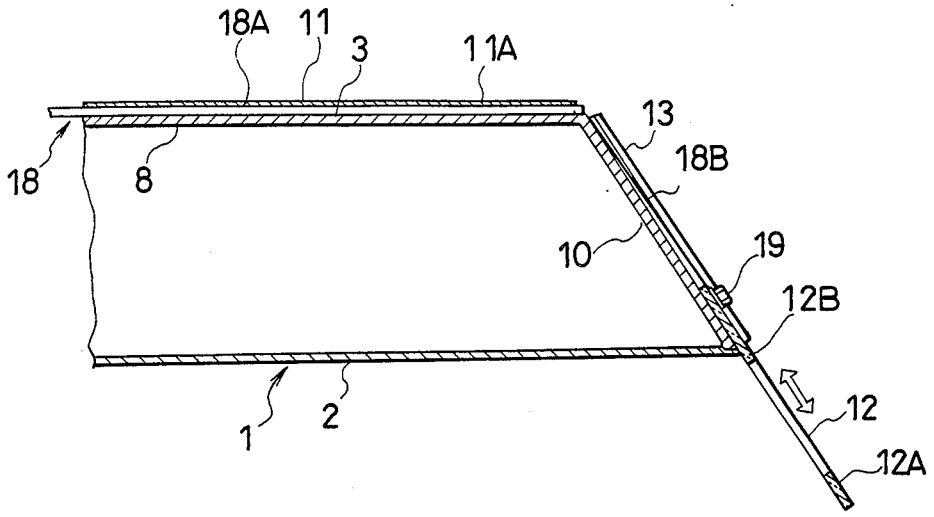
FIG. 3 is an enlarged view of the stern portion of the craft indicated at A in FIG. 1.

Referring further to FIG. 3, which depicts the stern part of the craft or the portion largely indicated at A in FIG. 1, the deck 3 has its stern side end shaped into a sloped landing 10 that is made integral with the rear end of the paired footboards 8. The sloped landing 10 is provided for a person in the water to readily climb onto the deck from the craft stern.

Also, the deck 3 may carry a cushion floor 11 made of sponge that overlies the footboards 8 to whose surface is the floor 11 is adhered.

Each of the footboards 8 is provided at the stern side end of the craft body 1 with a mounting board 12, preferably made of rubber, that is designed to extend far below the bottom of the hull 2 into the water, which constitutes the main feature of the present invention.

In this particular embodiment, the mounting board 12 is square in configuration, having at its lower edge a hold-on portion 12A onto which a displaced person trying to get on board through the board 12 to grip with his foot. Each of the mounting boards 12 may preferably be slidably disposed in the respective sloped landing 10 in such a manner that the board 12 can slide along the surface of the landing 10 between two positions, the raised position in which the board 12 stands just overlying the sloped surface of the landing and the lowered position where the board is moved downward relative to the landing 10 far below the bottom of the craft hull 2.

Each sloped landing 10 is provided at either side with a pair of parallelly extending guide rails 13 between which the mounting board 12 is slidably disposed such that it can be slided along the inclined surface of the landing 10, guided by the guide rails 13 on both sides, between the raised position, depicted in two-dot chain line, and the lowered position, shown in solid line in FIG. 2. With the mounting board 12 in this lowered position, a displaced person in the water may readily get on board from the stern. On the other hand, when the mounting boards are not used as during cruising, the boards are retracted into their raised positions.

In addition, it is so designed that, when the mounting boards 12 are lowered, they have their upper end portions 12B held stably in fixed position between the respective guide rail pair 13 on both sides, pressed against the surface of the sloped landing 10.

The mechanism for sliding the mounting boards 12 between their raised and lowered positions relative to the sloped landing 10 will be described in detail in accordance with a preferred embodiment.

As shown in FIGS. 1 and 2, the mechanism may be any known suitable hoisting device with a rotatable windup reel or hand winch consisting in the main of a drum 16 and a handle 17, preferably mounted in the rear wall of the engine hood 7 on the leftside of the deck 3, at a low point in the vehicle body enough to be within the arm's reach of a person outside the craft in normal position as when he, displaced by its overturning, in the water.

Each of the footboards 8 in the deck 3 carries in the center a longitudinal groove 11A formed beneath the cushion floor. A tube 18A is laid within the groove 11A, running between the upper end of the sloped landing 10 and the rear wall of the engine hood 7. The tube 18A on the leftside of the deck 3 or the same side on which the hand winch 17 is mounted is substantially linear, ending at a point in the deck 3 just below the handle 17. The other tube 18A is further extended to run upward within the engine hood 7 and bent left to end at a point just above the handle 17, as shown in broken line in FIG. 2. A proper length of wire rope 18B is passed through each of the tubes 18A, having its one end connected through a suitable fitting 19 to the upper end portion 12B of the respective mounting board 12. The other ends of the wire ropes 18B are secured to the drum 16 of the hand winch in such a manner that rotation of the handle 17 moves the wire ropes 18B simultaneously in the same direction through their respective tubes 18A.

With the above arrangement, when the handle is rotated in one direction or clockwise in FIG. 2, the wire ropes 18B are together caused to wind about the drum 16 bringing the mounting boards 12 from their lowered position into raised positions. On the other hand, rotating the handle 17 in the counter-clockwise causes the drum 16 to unwind the wire ropes 18B, allowing the mounting boards 12 to slide into lower positions.

Furthermore, since it is so designed that the mounting boards 12 in their lowered positions are supported far below the bottom of the hull 2, convenient enough for a displaced person to climb on board with increased ease, pulling himself up by exerting the muscles of his foot or knee resting on the board 12. In the case of an upturned double-rider small water craft from which the both riders were thrown into the water, it will normally be extremely hard for the second rider to get on board in the righted craft which is more likely to be in an imbalanced state because of the very weight of the first rider who first succeeded in remounting. Even if the craft is in such an imbalanced state, the mounting board 12 according to the present invention serves very much for the second rider to come on board with ease.

In addition, since the mounting boards 12 can be slided back into their raised positions, the craft can cruise smoothly, without the resistance of the water exerted on the surface of the otherwise lowered boards.

Moreover, since the mounting boards 12 in their lowered positions are held stably in fixed position by the lower part of the sloped landing 10 in conjunction with the paired guide rails on both side, they can properly support a person trying to climb on board from the water. Also, they extend at a proper angle with respect to the bottom of the hull in this position such that the displaced person can safely get onto the deck, without striking his shin against the hurting corner of the hull in struggling to hold grip onto the board surface.

Figure 4:
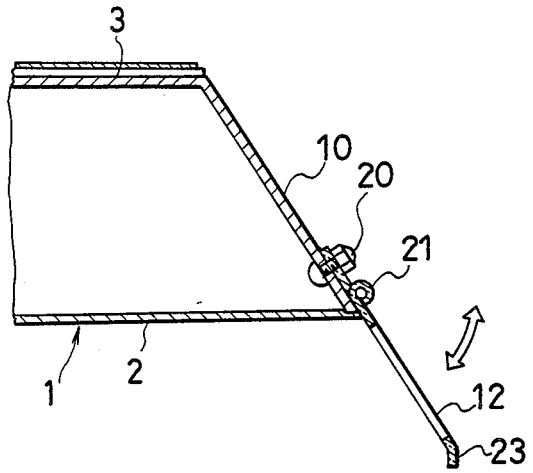
FIG. 4 is a view of a modified form of the mounting step attached to the water craft body at its stern shown in FIG. 3.

Referring further to FIG. 4, which illustrates a modification of the embodiment shown in FIGS. 1 through 3, the mounting board 12 is secured in fixed position to the sloped landing 10 at its lower end through a suitable fitting 20 or bolts. Also, the board 12 has at its upper portion, preferably at a point levelled with the bottom of the hull at the stern, a hinge 21 made of an elastic material such as plastic, preferably polypropyrene, or metal such that the board, when the craft is just floating still in the water, comes down into the water on its own weight, and, when the craft is running, it is forced into a horizontal position, by the pressure of the water. In addition, the mounting board 12 may preferably be bent at its lower end 23 to decrease resistance by the water when the craft is running.

What is claimed is:

1. In a small water craft of the type whose body includes an upper deck portion and a lower hull portion, with a standing platform formed in said deck portion at its lead part and a steering handle mounted in front of said standing platform in said deck portion, the improvement which comprises means for enabling a person to regain a position on the standing platform from outside the watercraft, said means including a mounting board slidably mounted on the lower hull portion to be moved from a position above the bottom of the hull to a position far below the plane of the bottom of the hull portion, and operating means on the water craft for moving said mounting board, said operating means being located to be within reach of a person outside the water craft and in the water when the water craft is in an upright orientation.

2. The improvement defined in claim 1 wherein said operating means includes a winding drum and a handle, with said handle being located at a low point on the upper deck portion.

3. The improvement defined in claim 2 further including a second mounting board.

4. The improvement defined in claim 3 further including cushion means on said mounting boards.

5. The improvement defined in claim 4 wherein each of said mounting boards includes a hold-on portion which is located and adapted to be engaged by a foot of a person who is located in the water.

* * * * *